US009252543B2

(12) United States Patent
Huang et al.

(10) Patent No.: US 9,252,543 B2
(45) Date of Patent: Feb. 2, 2016

(54) DUAL ORIENTATION CONNECTOR ASSEMBLY WITH INTERIOR MAGNETIC COMPONENT

(71) Applicant: FOXCONN INTERCONNECT TECHNOLOGY LIMITED, Grand Cayman (KY)

(72) Inventors: Shuai-Hui Huang, Kunshan (CN); Jian-Fang Li, Kunshan (CN); Hai-Li Wang, Kunshan (CN); Ru-Yang Guo, Kunshan (CN); Qing-Man Zhu, Kunshan (CN); Jerry Wu, Irvine, CA (US)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 14/604,767

(22) Filed: Jan. 26, 2015

(65) Prior Publication Data

US 2015/0214677 A1 Jul. 30, 2015

(30) Foreign Application Priority Data

Jan. 24, 2014 (CN) ..... 2014 1 0032711
Jan. 24, 2014 (CN) ..... 2014 1 0032712

(51) Int. Cl.

| | |
|---|---|
| ***H01R 11/30*** | (2006.01) |
| ***H01R 13/717*** | (2006.01) |
| ***H01R 13/62*** | (2006.01) |
| ***H01R 13/66*** | (2006.01) |

(52) U.S. Cl.
CPC ..... *H01R 13/7175* (2013.01); *H01R 13/6205* (2013.01); *H01R 13/6658* (2013.01)

(58) Field of Classification Search
USPC ..... 439/39
See application file for complete search history.

(56) References Cited

U.S. PATENT DOCUMENTS

| | | | | |
|---|---|---|---|---|
| 7,311,526 | B2 | 12/2007 | Rohrbach et al. | |
| 8,535,088 | B2 | 9/2013 | Gao et al. | |
| 8,758,025 | B1 * | 6/2014 | Liljegren | H01R 13/6205 439/39 |
| 8,790,120 | B2 | 7/2014 | Wang et al. | |
| 8,939,773 | B2 * | 1/2015 | McCormack | H01R 13/6205 439/39 |
| 2013/0210244 | A1 | 8/2013 | DiFonzo et al. | |
| 2015/0062828 | A1 * | 3/2015 | Shirai | H01R 13/6205 439/39 |

* cited by examiner

*Primary Examiner* — Tho D Ta
(74) *Attorney, Agent, or Firm* — Wei Te Chung; Ming Chieh Chang

(57) ABSTRACT

A dual orientation connector assembly for mating with a mating connector in two directions, including: an insulative housing defining a side wall, a printed circuit board (PCB) received in the housing, a mating member soldered on the PCB, a cable extending from an end of the insulative housing, and a magnetic component disposed in the insulative housing to provide a retaining force for retaining to the mating connector. The mating member includes a mounting portion received in the insulative housing, a mating portion extending out of the side wall of the insulative housing for mating with the mating connector, and a number of terminals mounted in the mating portion. The mating portion includes a first surface and an opposite second surface. The first surface and the second surface have the same number of the terminals.

10 Claims, 5 Drawing Sheets

DUAL ORIENTATION CONNECTOR ASSEMBLY WITH INTERIOR MAGNETIC COMPONENT

BACKGROUND OF THE INVENTION

1. Field of the Invention

The present invention relates to a dual orientation connector assembly, and more particularly to magnetic components of the dual orientation connector assembly.

2. Description of Related Arts

U.S. Pat. No. 8,790,120, issued on Jul. 29, 2014, discloses a receptacle and an electric connector. The receptacle of the portable electronic device has at least one magnetic component, and the electric connector includes at least one magnetic component. The magnetic component may be adhered to the contact surface of the sliding base through an adhesive tape. A magnetic polarity of the magnetic component of the electric connector is different from a magnetic polarity of the magnetic component of the receptacle.

U.S. Patent Application Publication No. 2013/0210244, published on Aug. 15, 2013, discloses a magnetic connector system including portions of connector insert and connector receptacle. Connector receptacle may include one or more magnets, which may be covered by label. Connector insert may include an attraction plate. Magnetic field lines originating in first magnet may pass through the label and the attraction plate and terminate in second magnet. Magnetic field lines originating in a North pole of magnet may pass through label and attraction plate and terminate at a South pole of magnet. The attraction force between the first and the second magnets makes the connector insert and connector receptacle engage to each other.

An improved dual orientation connector assembly is desired to offer advantages over the related art.

SUMMARY OF THE INVENTION

An object of the present invention is to provide a dual orientation connector assembly, and more particularly to a dual orientation connector assembly with stable structure and beautiful appearance.

To achieve the above-mentioned object, a dual orientation connector assembly for mating with a mating connector in two directions, including: an insulative housing defining a side wall, a printed circuit board (PCB) received in the housing, a mating member soldered on the PCB, a cable extending from an end of the insulative housing, and a magnetic component disposed in the insulative housing to provide a retaining force for retaining to the mating connector. The mating member includes a mounting portion received in the insulative housing, a mating portion extending out of the side wall of the insulative housing for mating with the mating connector, and a plurality of terminals mounted in the mating portion. The mating portion includes a first surface and an opposite second surface. The first surface and the second surface have the same number of the terminals.

According to the present invention, the magnetic components of the dual orientation connector assembly in this invention are disposed in the insulative housing. The magnetic components will not fall down due to many times insertion. The dual orientation connector assembly has good appearance.

DETAILED DESCRIPTION OF THE PREFERRED EMBODIMENT

Figure 1:
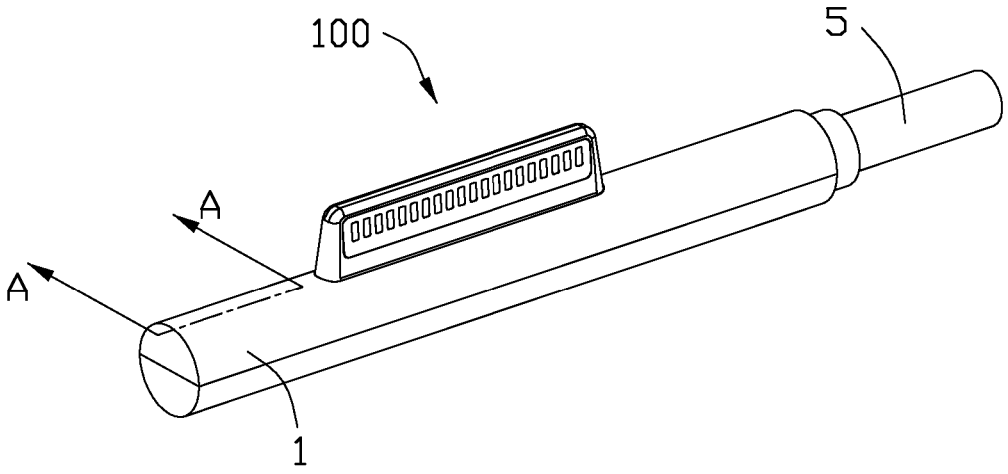
FIG. 1 is a perspective view of a dual orientation connector assembly in accordance with the present invention.
Figure 2:
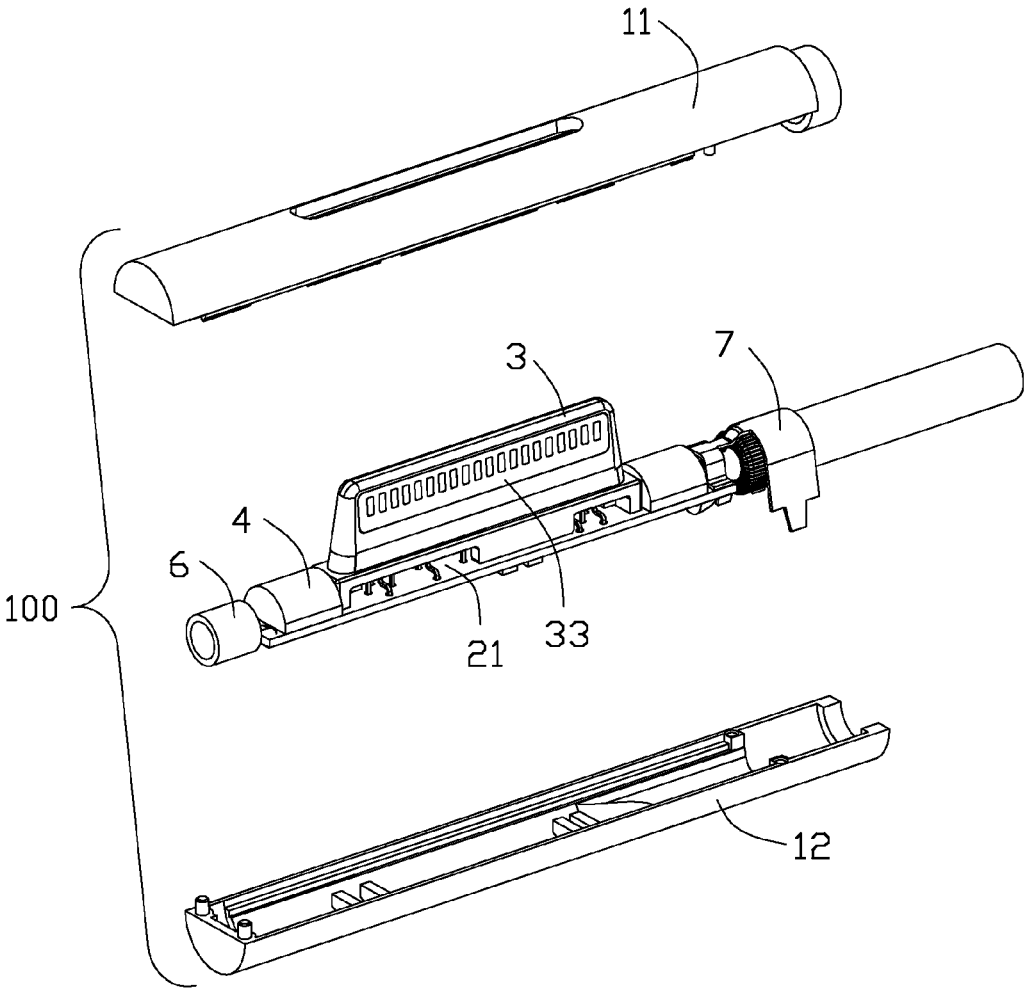
FIG. 2 is a partly exploded view of the dual orientation connector assembly as shown in FIG. 1.
Figure 3:
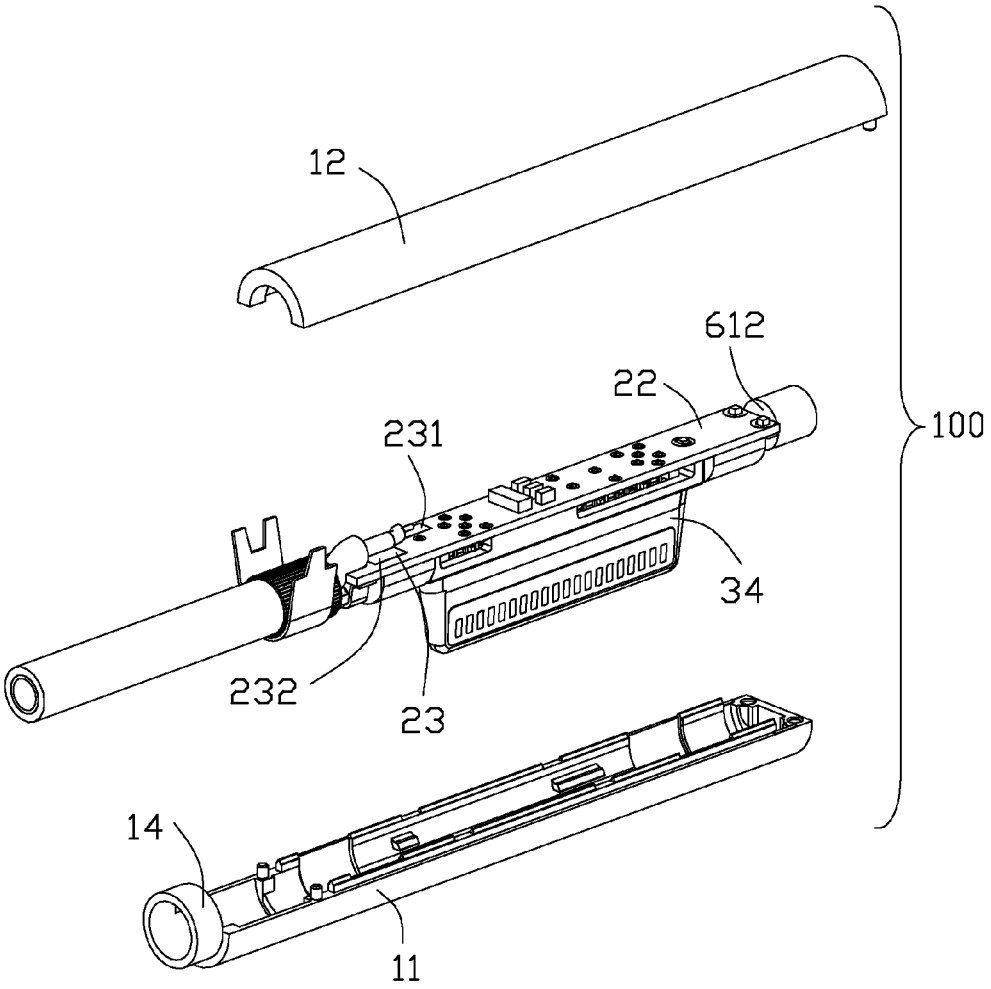
FIG. 3 is another partly exploded view of the dual orientation connector assembly as shown in FIG. 2.
Figure 4:
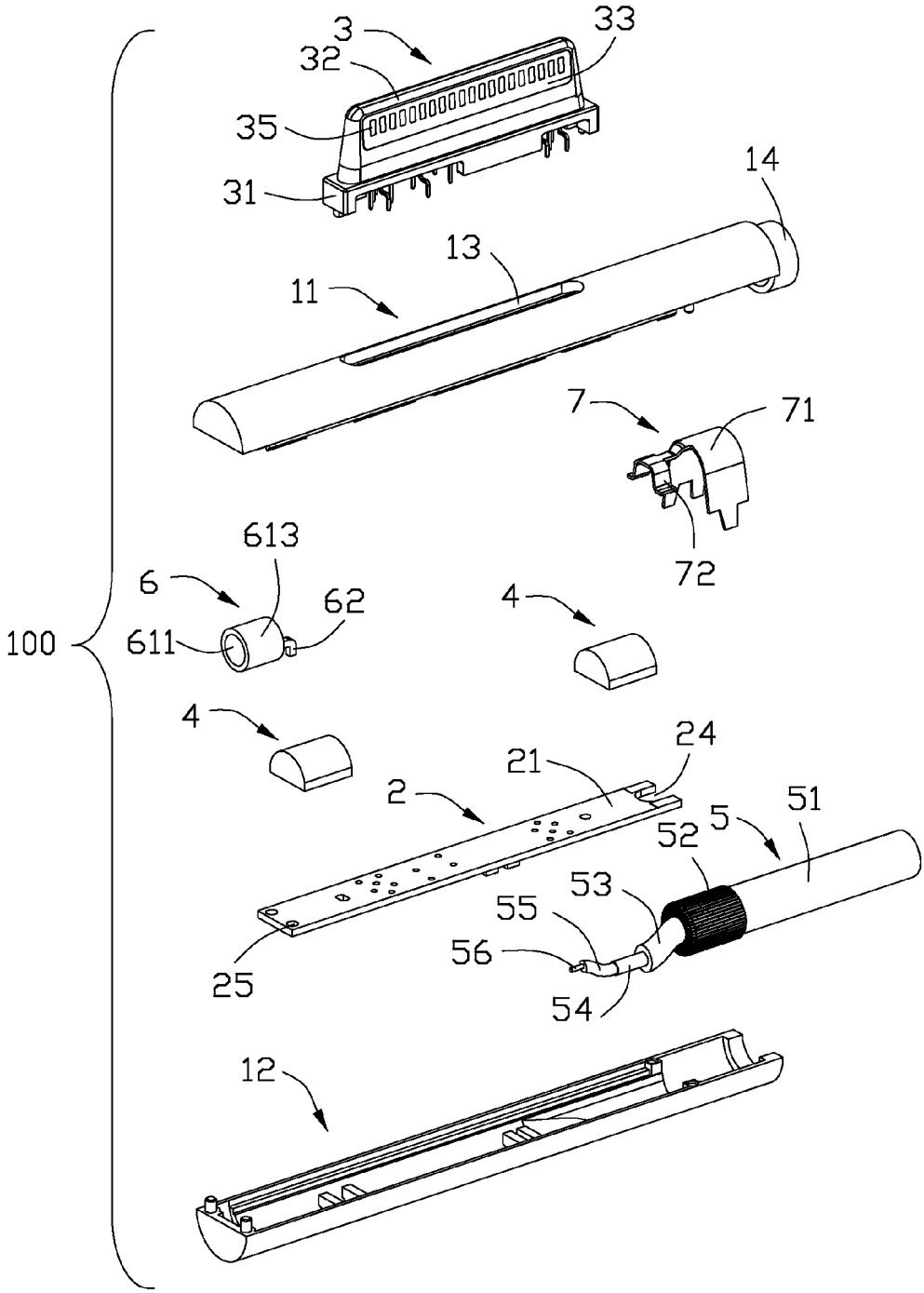
FIG. 4 is an exploded view of the dual orientation connector assembly as shown in FIG. 1.

Reference will now be made in detail to some preferred embodiments of the present invention.

Referring to FIGS. 1 to 4, a dual orientation connector assembly 100 for mating with a complementary connector (not shown) in two directions comprises an insulative housing 1, a printed circuit board (PCB) 2 received in the insulative housing 1, a mating member 3 soldered on the PCB 2, a pair of magnetic components 4 disposed in the insulative housing 1, a cable 5 extended from an end of the insulative housing 1, an LED (light emitting diode) 6 soldered on another end of the insulative housing 1, and a metal member 7 mounted on one end of the cable 5.

Figure 5:
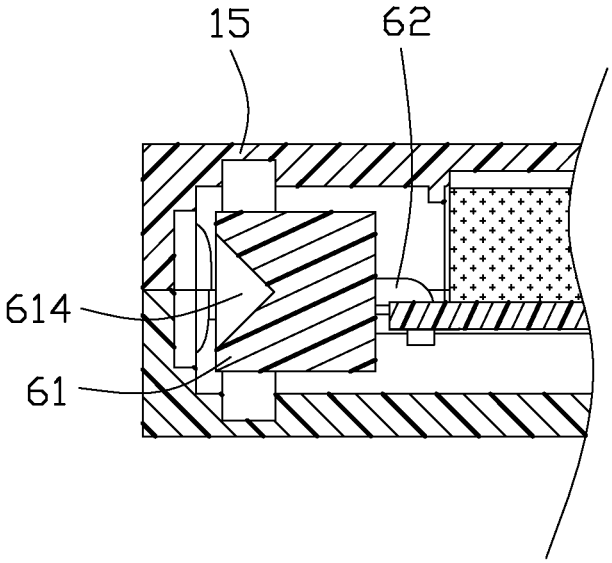
FIG. 5 is a cross-sectional view of the dual orientation connector assembly taken along line 5-5 of FIG. 1.

The insulative housing 1 is generally cylindrical. The insulative housing 1 comprises a first housing part 11 and a second housing part 12 mounted with the first housing part 11. The first housing part 11 comprises an opening 13 for being extended by the mating member 3 out of the insulative housing 1. A tail end of the first housing part 11 has an annular portion 14. Referring to FIG. 5, the insulative housing 1 comprises a light area 15. A wall thickness of the light area 15 is thinner than the wall thickness of the other portion of the insulative housing 1 to make the light through the light area 15 more visible or brighter. The insulative housing 1 comprises a side wall.

The PCB 2 comprises an upper surface 21 and an opposite lower surface 22. The PCB 2 comprises a plurality of conductive pads 23 disposed on the lower surface 22 of the PCB 2. The conductive pads 23 comprise a signal pad 231 for transmitting control signal and a power pad 232 for transmitting power signal. A size of the power pad 232 is greater than the size of the signal pad 231. The end of the PCB 2 closed to the cable 5 recesses inwardly to form a holding slot 24. Another end of the PCB 2 comprises a hole 25 for mounting the LED 6.

The mating member 3 is mounted on the upper surface 22 of the PCB 2. The mating member 3 comprises a mounting portion 31 received in the insulative housing 1 and a mating portion 32 extending out of the side wall of the insulative housing 1 for mating with the mating connector. The mating portion 32 comprises a first surface 33 and an opposite second surface 34. The first surface 33 and the second surface 34 comprise same number of terminals 35.

The pair of magnetic components 4 are mounted on the upper surface 21 of the PCB 2 and disposed on two sides of the mounting portion 31 of the mating member 3, respectively. The magnetic components 4 provide a retaining force when the dual orientation connector assembly 100 is mated with the mating connector.

The cable 5 is soldered on the lower surface 22 of the PCB 2. The cable 5 comprises an outer layer 51, a braid layer 52 enclosed in the outer layer 51, a first insulative layer 53 enclosed in the braid layer 52, a first conductor 54 enclosed in the first insulative layer 53, a second insulative layer 55 enclosed in the first conductor 54, and a second conductor 56 enclosed in the second insulative layer 55. The first conductor 54 of the cable 5 is soldered with the power pad 232, and the second conductor 56 is soldered with the signal pad 231. The first insulative layer 53 of the cable 5 is held by the holding slot 24 so that the cable 5 can be soldered with the conductive pads 23 stably.

The LED 6 comprises a lamp 61 and a connecting portion 62 electrically connected with the PCB 2. The lamp 61 comprises a first face 611, an opposite second face 612, and a side face 613 connecting the first face 611 and the second face 612. The connecting portion 62 extends from the second face 612 of the lamp 61 and bends into the hole 25 of the PCB 2. The connecting portion 62 is fixed with the PCB 2 by soldering. The first face 611 recesses toward the second face 612 to form a taper surface 614. The taper surface 614 has a coating layer made of reflective material to increase the efficiency of reflection. The light revealed by the lamp 61 emits from the side face 613 after being reflected by the taper surface 614. The taper surface 614 is a conical surface so that the light can form a light ring after being reflected. An angle of a center line and a generatrix of the taper surface 614 is about 45° so that the light can be emitted vertically after being emitted horizontally to the taper surface 614. The light emitted from the side face 613 passes through the light area 15 of the insulative housing 1. A height of the taper surface 614 is equal to the width of the light area 15. A distance from a top of the taper surface 614 to the first face 611 is shorter than the distance from the second face 612 to the first face 611.

The metal member 7 is mounted on the end of the cable 5. The metal member 7 comprises a crimping portion 71 mounted on the braid layer 52 of the cable 5 and a holding portion 72 extending from the crimping portion 71 and making the first insulative layer 53 hold onto the PCB 2.

When assembling the dual orientation connector assembly 100, the mating member 3 is soldered on the PCB 2 firstly. The cable 5 is then peeled and the braid layer 52 turned over onto the outer layer 51 to expose the first insulative layer 53, the first conductor 54, the second insulative layer 55, and the second conductor 56. The cable 5 is put on the end of the PCB 2. Then the first insulative layer 53 is held in the holding slot 24 of the PCB 2. The second conductor 56 is soldered to the signal pad 231 on the lower surface 22 of the PCB 2, and the first conductor 54 is soldered to the power pad 232. The crimping portion 71 of the metal member 7 is placed on the braid layer 52, and the holding portion 72 is placed on the upper surface 21 of the PCB 2 and holds the first insulative layer 53. The crimping portion 71 is bent to form a ring to enclose the braid layer 52 of the cable 5. The magnetic components 4 are placed on both sides of the mating member 3, respectively, and double-sided adhesives are used to fix the magnetic components 4. The connecting portion 62 of the LED 6 is inserted into the hole 25 of the PCB 2. The LED 6 is fixed by soldering. The annular portion 14 of the first housing part 11 is set from the cable 5. Lifting the first housing part 11 to make the mating member 3 extend out of the first housing part 11 from the opening 13. The first housing part 11 and the second housing part 12 are assembled together to receive the PCB 2. The first housing part 11 and the second housing part 12 are fixed by the technology of ultrasonic fusion-bonding. Peptide compounds can be filled into the insulative housing 1 to make the light sent out by the LED 6 evenly.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A dual orientation connector assembly for mating with a mating connector in two directions, comprising:

an insulative housing including a side wall;

a printed circuit board (PCB) received in the housing;

a mating member soldered on the PCB, the mating member comprising a mounting portion received in the insulative housing, a mating portion extending out of the side wall of the insulative housing for mating with the mating connector, and a plurality of terminals mounted in the mating portion, the mating portion comprising a first surface and an opposite second surface, the number of the terminals on the first surface and the number of the terminals on the second surface being equal to each other;

a cable extending from an end of the insulative housing;

a pair of magnetic components are mounted on the PCB and disposed on two sides of the mounting portion of the mating member, respectively to provide a retaining force for retaining to the mating connector; wherein the PCB comprises a plurality of conductive pads, the conductive pads including a signal pad for transmitting control signal and a power pad for transmitting power signal, and the cable comprises a first conductor soldered with the power pad and a second conductor soldered with the signal pad; wherein an end of the PCB proximal to the cable recesses inwardly to form a holding slot, and the cable comprises a first insulative layer enclosing the first conductor and held by the holding slot;

a metal member mounted on the end of the cable, and wherein the cable comprises a braid layer enclosing the first insulative layer, the metal member comprising a crimping portion mounted on the braid layer and a holding portion extending from the crimping portion and holding the first insulative layer on the PCB; and a light emitting diode (LED) soldered in the insulative housing, the LED comprising a lamp and a connecting portion electrically connected with the PCB, the lamp comprising a first face, a second face, and a side face connecting the first face and the second face, the first face recessing toward the second face to form a taper surface, the taper surface reflecting the light emitted from the side face.

2. The dual orientation connector assembly as recited in claim 1, wherein the insulative housing is cylindrical.

3. The dual orientation connector assembly as recited in claim 2, wherein the insulative housing comprises a first housing part and a second housing part mounted to the first housing part, the first housing part comprising an opening for the mating member to extend out of the insulative housing.

4. The dual orientation connector assembly as recited in claim 3, wherein the first housing part and the second housing part are fixed by ultrasonic fusion-bonding.

5. The dual orientation connector assembly as recited in claim 1, wherein the taper surface comprises a coating layer made of reflective material.

6. The dual orientation connector assembly as recited in claim 5, wherein the taper surface comprises a conical surface to form a light ring.

7. The dual orientation connector assembly as recited in claim 6, wherein an angle between a center line and a generatrix of the taper surface is about 45 degrees.

8. An electrical connector assembly comprising:

a printed circuit board extending along both a longitudinal direction and a transverse direction perpendicular to each other;

a housing enclosing said printed circuit board;

a mating member mounted to the printed circuit board and extending out of the housing;

a cable linked around one lengthwise end of the printed circuit board and extending out of a corresponding lengthwise end of the housing; and a light device mounted to the other lengthwise end of the printed circuit board and located around the other lengthwise end of the housing; wherein said light device is equipped with a conical structure to reflect an axial light to a circumferential light instead of using a ring type light waveguide to convert a straight light to the circumferential light; wherein the housing forms a circumferential light area essentially aligned with the conical structure radially and having a thinned structure to allow the circumferential light to emit therefrom; wherein said housing defines a cylindrical space to receive said printed circuit board, and a pair of magnetic components are mounted upon the printed circuit board and located by two sides of the mating member in said lengthwise direction.

9. The electrical connector assembly as claimed in claim 8, wherein said mating member extends away from the printed circuit board in a vertical direction perpendicular to both said longitudinal direction and said transverse direction.

10. The electrical connector assembly as claimed in claim 8, wherein each of said magnetic component is shaped as one half of a round column.

* * * * *